United States Patent [19]

Taylor

[11] 4,277,105

[45] Jul. 7, 1981

[54] CONVEYOR SYSTEM FOR A CONTINUOUS MINING MACHINE

[76] Inventor: John C. Taylor, 128 Fairway Dr., LaFollette, Tenn. 37766

[21] Appl. No.: 64,565

[22] Filed: Aug. 7, 1979

[51] Int. Cl.[3] ..... E21B 35/70

[52] U.S. Cl. ..... 299/64; 198/520; 299/76

[58] Field of Search ..... 299/64, 76, 78, 67; 198/520

[56] References Cited

U.S. PATENT DOCUMENTS

| | | | |
|---|---|---|---|
| 1,336,440 | 4/1920 | O'Toole | 299/64X |
| 1,410,563 | 3/1922 | Porter | 299/67 |
| 2,751,209 | 6/1956 | Barrett | 198/520 X |
| 3,088,718 | 5/1963 | Lilly | 299/64 |
| 3,288,536 | 11/1966 | Galis et al. | 296/64 X |
| 3,876,252 | 4/1975 | Cilles | 299/64 X |

*Primary Examiner*—William F. Pate, III

*Attorney, Agent, or Firm*—Pitts & Kesterson

[57] ABSTRACT

A conveyor gathering systems suitable for use with a continuous narrow seam mining machine is disclosed. The system is a single continuous conveyor extending from the auger or cutting head to the rear or discharge end of the machine and is particularly useful with a dozer gathering head. Conveying of the mined material is achieved by an endless conveyor comprised of "flight bars" attached at each end to two drive chains. The single continuous conveyor is driven from the rear of the mining machine, may pivot up and down, and makes a very small diameter, 180 degree turn around, at the front of the mining machine adjacent the auger or cutting head. Because the conveying system uses a single continuous system of flight bars, the tensions on the conveyor can be significantly reduced such that the conveyor drive motor can be selected having a work capacity less than one half of other systems.

5 Claims, 4 Drawing Figures

CONVEYOR SYSTEM FOR A CONTINUOUS MINING MACHINE

BACKGROUND OF THE INVENTION

This invention relates to a conveying system for use with a continuous mining machine for continuously moving mined material such as coal from the auger or cutting head to the rear or discharge end of the machine for transporting out of the mine. More particularly, this invention relates to a conveying system suitable for use with a continuous narrow seam coal mining machine having a dozer type gathering head. Since mining machines are operated in harsh, wet and corrosive environments, and are required to remove tons of material each day, it is advantagous to keep the number of moving parts in any mining machine to a minimum to reduce the necessary maintenance and repair. However, because of space limitations and lower cost requirements which are further imposed on low seam machines, the need for reduced maintenance is of even greater importance.

There are several types of conveying systems used with modern mining machines. These systems include multistage continuous conveyors having mat chains as the front stage and flight bars as the back stage; flight bar conveyors driven by a single centrally located chain, and flight bar conveyors which may curve in the middle of their travel to bend around corners. Various types of these different conveying systems are described for example in U.S. Pat. Nos. 3,044,753 issued to A. G. Wilcox, Jr., July 17, 1962; 3,116,914 issued to W. G. Young et al, Jan. 7, 1964; 3,161,439 issued to J. S. Newton et al, Dec. 15, 1964; 3,774,969 issued to M. K. Lebegue, Nov. 27, 1973; 3,860,291, issued to Rauch et al, Jan. 14, 1975; and 3,892,443 issued to E. M. Arentezen, July 1, 1975.

The Wilcox U.S. Pat. No. 3,044,753, discloses a continuous mining machine having a full width cutting head or auger which may be pivoted so that it can mine seams which may be classified as medium to high. The machine includes a containing structure having upwardly U shaped sides within which ride flight bars which are attached at their center points to an endless chain. The material cut from the seam by the auger head is conveyed by a gathering head to the flight bar conveying system. The gathering head includes a helical or gathering scroll having an axis parallel with the axis of the cutting auger. The helical scroll cooperates with a conveyor pan to move coal or mined material which has been dislodged along the length of the cutting auger and fallen on the floor of the mine to the center of the machine such that it can be picked up by the flight bar conveyor. The helical scroll is driven by a driving means located close therewith, which in turn provides a sprocket driven to the single centrally located chain of the flight bar conveying system. It should be noted, that the scoop and helical gathering systems is of significant importance with this type of mining machine since the auger cutting head may pivot a significant distance away from the gathering system and thus the cutting auger cannot serve to move the mined material from the edges of the machine to the center of the machine.

The U.S. Pat. No. 3,116,914 issued to Young et al, includes a conveying system essentially the same as that disclosed in the Wilcox patent. However, in addition, the conveying flight bar system of this Young et al patent has flexible sides so that the conveyor may be made to bend in the middle area and thereby convey mined material or coal around a curve. In addition, the Young et al patent describes a different type cutting head. According to the Young patent, removal or dislodging of material to be mined is accomplished by a "ripper head" which comprises a series of toothed continuous chains which are urged forward to engage the material being mined. As was the case with respect to the Wilcox patent, it is of significant importance to note that the gathering system of this invention also uses a helical or scroll gathering head which works in cooperation with a scoop that rides or scrapes along the floor of the mine. Thus, as the mining machine moves forward, coal is dislodged and falls onto the floor of the mine, is scraped into the scoop and is then conveyed towards the center of the mining machine by the scroll gathering head where it is picked up by the flight bars and conveyed to the rear of the machine for subsequent transporting out of the mine.

The mining machine disclosed by U.S. Pat. No. 3,161,439 issued to Newton et al, also discloses a conveyor system similar to that disclosed in both the Wilcox and the Young et al patents. However, this patent discloses still a third type of cutting head. The cutting head of the Newton et al patent is of the side cutting auger type. However, as was the case with the previously discussed patents, of significant importance and consideration is the use of the helical or scroll gathering head which operates in cooperation with a scoop which in turns rubs or scrapes against the floor of the mine such that dislodged material is picked up by the scoop and moved towards the center of the mining machine by the helical head from which center it is then picked up by the gathering head and moved to the rear of the machine.

U.S. Pat. No. 3,774,969 issued to Lebegue shows yet another type mining machine which uses a conveyor system similar to that discussed with respect to the Wilcox, Young et al and Newton et al machines. This mining machine uses yet another type of cutting or auger head. However, as was the case with the previously discussed patents a helical or spiral gathering system is used in cooperation with a scoop which rubs or scrapes along the bottom of the mine and picks up material which is conveyed to the center of the machine where it is further picked up by the flight bar conveying system and routed to the rear of the machine where it is discharged.

Thus, it is seen from the mining machines discussed heretofore, a flight bar conveying system is disclosed which works in conjunction with a helical scroll and scoop gathering system. It will also be noted that the flight bar conveying system of each of the discussed patents uses a single chain to which the flight bars are attached at the center points. In addition, the chain and flight bars accomplish a 180° turn around by means of a sprocket having a diameter the same as the helical gathering head. It will also be appreciated that the cost of the helical scroll and scoop gathering head is not insignificant.

U.S. Pat. Nos. 3,860,291 and 3,892,443 issued to Rauch et al and Arentezen respectively and each assigned to Dresser Industries disclose two aspects of a gathering system different from that heretofore discussed. The mining machine according to these two patents uses a auger type cutting head similar to that discussed wih respect to the Wilcox patent. However, the Dresser patents use an entirely different type of gathering system. The gathering system of the Dresser patents is referred to as a dozer type gathering system. The dozer type gathering system has been found particularly suitable for use with machines primarily used in mining very narrow seams of coal. According to this gathering system, the cutting auger itself works in cooperation with a backup panel and a dozer head or blade to gather the coal. In addition, the conveying system itself always remains in close proximity to the cutting head. Since the dozer blade or backup panel is always located only a short distance away from the auger cutting head itself, it will be appreciated that according to this technique and because of the close proximity of the dozer blades and backup panels, as the mined material is cut loose from the mine face it cannot fall a significant distance from the cutting auger and therefore the auger head itself working in conjunction with the backup panel or dozer head serves to convey the mined material toward the center of the machine. Once at the center of the machine, a "window" or "throat" in the dozer blade and backup panel, allows the coal to accumulate on a front conveyor. The conveyor system of the Dresser machine uses a front continuous conveyor and a rear continuous conveyor such that coal must be transferred from the front conveyor system which works in close proximity to the cutting auger head to the rear continuous conveying system. This front portion is a chain mat type continuous conveyor. The chain mat thus conveys coal from the auger cutting head to the rear of the first conveyor where the coal is then transferred to the rear conveyor which is a flight-bar continuous conveyor. A pivot proximate the location where the front and rear continuous conveyor systems meet, allows the front conveyor system to pivot such that it can follow and thus stay close to the cutting auger heads. Although mining machines of this type are widely used as a narrow seam mining machine, the chain mat conveying system presents continuous problems in maintenance. Experience has shown, that the chain mat front conveyor requires continuous servicing and maintenance. The chain mats also represent the one item requiring the most short term replacement. In addition because the chain mat has little or no structure providing transverse motion against the mined material, it is not unusual for the mined material simply to be tumbled in place as the mat moves under it rather than moving the mined material to the rear or discharge end of the machine. Thus, large lumps of the mined material such as coal tend to be further broken or pulverized thereby decreasing the overall value of the mined material. Furthermore, the juncture of the first portion of the conveyor system using chain mats, with the rearward portion or flight bar portion of the conveying system results in a point in the conveyor system where coal or mined material tends to accumulate without being continuously moved towards the rear of the mining machine. Finally, it will be appreciated by those skilled in the art that significantly greater tension must be maintained on a chain mat conveying system than on a flight bar conveying system. Thus, because of the required increased tension of the chain mat front conveyor and the additional gearing required to drive two conveying systems, the motor or drive means for the overall conveying system of this type mining machine must have significant work capacity.

Thus, from the afore-mentioned discussions of the prior art patents, it will be appreciated that heretofore both inexpensive and effective gathering and conveying systems have not been available. Accordingly, it is an object of this invention to provide methods and apparatus for inexpensively and effectively conveying mined material from the cutting head to the rear discharge area of a mining machine.

It is another object of this invention to provide a single conveyor which moves coal continuously from the auger cutting head to the rear of the mining machine.

It is still another object of this invention to provide a conveyor which requires minimum maintenance and is suitable for use with a dozer type gathering head.

It is yet another object of this invention to provide a conveyor for use with a narrow seam mining machine, which conveyor requires substantially less driving power than machines available heretofore.

Still another object of this invention is to provide a conveyor which will continuously move mined material away from the cutting head to avoid pulverization of large lumps of mined material.

These and other objects, which will become evident from the following drawings and detailed descriptions are accomplished by the present invention by the use of a single continuous conveyor used with a dozer type gathering head continuous mining machine. The conveyor comprises a driving means which drives or rotates a drive sprocket mounted at the rear portion of the mining machine. Two continuous and parallel drive chains extend from a small diameter turn around shaft at the front most portion of the dozer gathering head to the drive sprocket at the rear of the machine; which drive sprocket drive the chains. The turnaround shaft at the front of the machine has a diameter substantially the length of a link of said drive chains. A multiplicity of "flight bars" extend between and are attached to the two parallel drive chains such that mined materials dislodged by the mining machine is moved rearward by the flight bars as the drive sprocket imparts motion to the flight bars and chains combination.

BRIEF DESCRIPTION OF THE DRAWINGS

Accordingly, the above mentioned objects and subsequent description will be more readily understood by reference to the following drawings wherein.

DETAILED DESCRIPTION OF THE INVENTION

Figure 1:
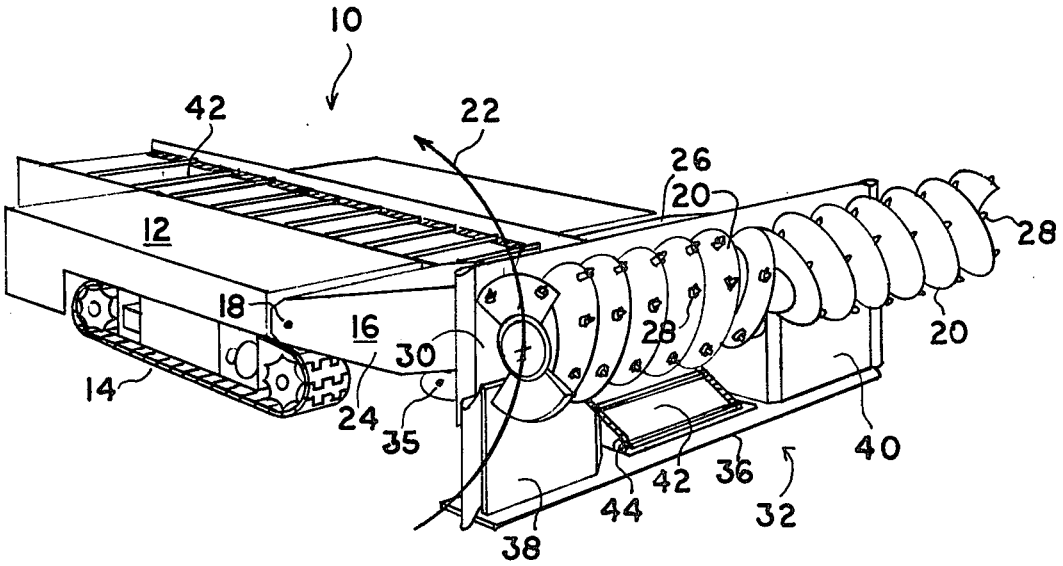
FIG. 1 illustrates a perspective view of a narrow seam coal mining machine incorporating the conveyor of this invention.

Referring now to FIG. 1 there is shown continuous mining machine 10 incorporating the new and unique conveyor of this invention, which machine 10 is suitable for mining narrow or low seams of materials, including for example, coal. In the disclosed embodiment, there is a supporting or tractor body 12 which includes a driving motor (not shown) and endless crawler tractor treads 14 disposed on each side of body 12 and used to advance the machine along the mine. Pivotally attached to body 14 is a mining head 16 which pivots at location 18 such that the rotary auger or cutting head 20 will follow arcuate arrow 22. It will be appreciated by those skilled in the art, that the mining head 16 may preferably operate with a sump frame. Although not essential to the operation of this invention, a sump frame mining machine includes hydraulic cylinders (not shown) which can be used to force the mining head 16 forward into the mine face while the supporting or tractor body 12 remains motionless. This means, that the tractor treads 14 may be locked into position as the cutting or mining head 16 is advanced into the coal seam by means of the sump frame. It will further be appreciated that the tractor treads 14 are typically of conventional construction, and have typical driving means. Thus, by subjecting the driving means to suitable controls, then either or both of the endless treads may be advanced or reversed to effect a desired forward turning or rearward movement of the machine. As mentioned above, since the preferred mining machine includes a sliding sump frame, the tractor treads 14 may remained locked while advancing or sumping the rotary cutting head or auger 20 into the mine face. This type design takes advantage of the difference between the coefficient of friction of fixed crawler treads, and the dynamic coefficient of friction.

The mining head 16 has two parallel support arms 24 and 26 that support the rotary cutter head or auger 20. The auger or rotary cutter 20 is driven by a second driving source (not shown). Thus, in operation, rotation of the auger or cutting head 20 brings the series of teeth 28 against the face of the mine thereby dislodging the coal or other material being mined. Directly behind and in close proximatey to the auger 20 is a vertical back up panel 30 which as will be discussed hereinafter works in cooperation with a "dozer type" gathering head to form a continuous vertical wall behind auger cutter 20.

A gathering head structure 32 having some similarity to the gathering head described in Dresser U.S. Pat. Nos. 3,860,291 and 3,892,443 works in cooperation with the cutting head or auger 20 and the backup panel 30. Gathering head 32 having side walls 34 is pivotally mounted at pivot point 35 which is separate from the pivot point 18 of the mining head 16. The gathering head structure 32 includes a leading edge 36 which scrapes along the floor of the mine, and two vertical blades or panels 38 and 40 on each side of the conveyor 42. As will be discussed in detail hereinafter, small diameter turnaround shaft or roller 44 of conveyor 42 is positioned very close to the front or leading edge 36 of the gathering head 32 such that the front most portion of conveyor 42 is always at a close location with respect to the auger or cutting head. The vertical panels or blades 38 and 40 cooperate directly with the vertical backup panels 30 of the gathering head 32 such that when mining head 16 is pivoted around point 18 vertical blades or panels 38 and 40 slide or telescope parallel with respect to backup panels 30 such that a continuous vertical wall of either the backup panels 30, or a combination of vertical blades 38 and 40 and the backup panels 30 are presented to the mine face. The mine face itself of course, forms an opposing continuous wall. Thus, it will be appreciated that the vertical wall formed by the backup panels, and the vertical wall formed by the mine face cooperate with the cutter auger 20 itself to act as a gathering system. Therefore, it can be seen that materials dislodged from the mining face cannot escape any significant distance from the auger cutting head 20 since such materials is trapped by the surrounding "walls," and consequently as the auger cutting head 20 continues to rotate the dislodged material is carried towards the center of the mining machine towards conveyor 42. Once carried to the center of the mining machine, the dislodged material is transferred on to the conveyor 42 of this invention where it is then carried from the face of the mine towards the rear or discharged end of the mining machine. As will also be appreciated by those skilled in the art, since a "dozer type" gathering head uses few moving parts, and depends upon the auger structure of the cutting head to move the mined material to the center of the mining machine where it is transferred to conveyor 42 and moved to the rear of the machine a substantial cost savings can be appreciated.

Figure 2:
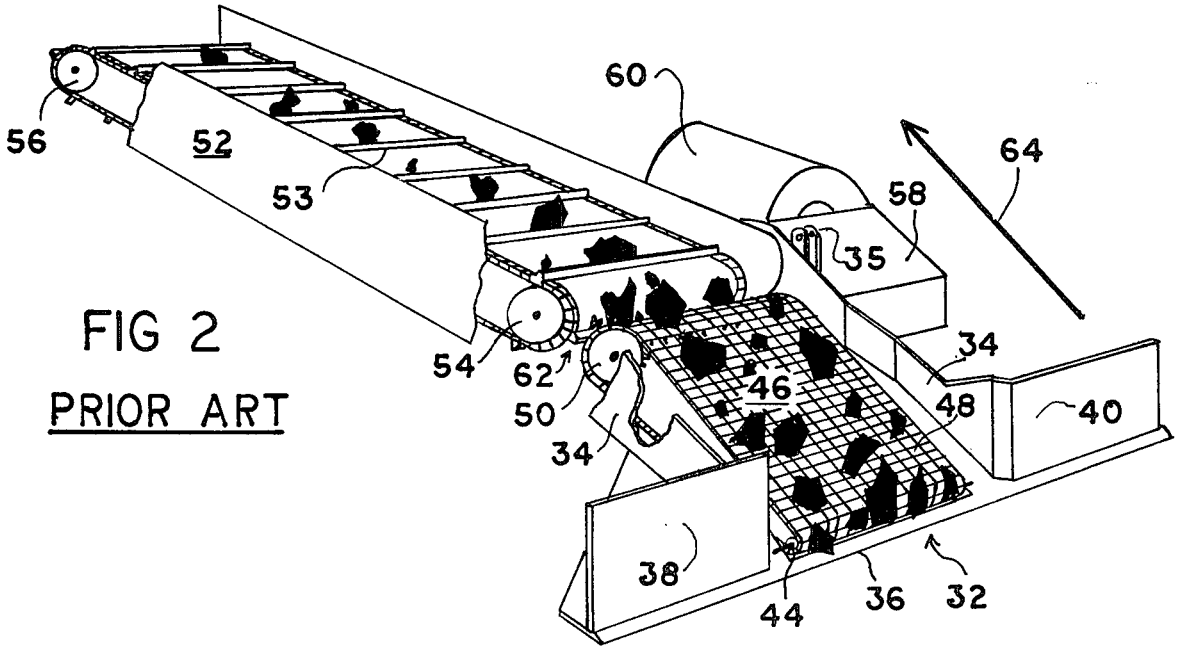
FIG 2 PRIOR ART
FIG. 2 is a top perspective view of a prior art conveying system showing the accumulation of coal at the juncture of the front and rear continuous conveying system and the small lumps of mined material due to pulverization at the dozer head.

Referring now to FIG. 2, there is shown a perspective and breakaway view of the conveying system of the prior art machine such as described in Dresser U.S. Pat. Nos. 3,860,291 and 3,892,443. According to this prior art machine it will be seen that there is a front conveyor 46 which includes a continuous chain mat 48, which pivots around a rear toothed drive sprocket 50 of a rather large diameter and front turnaround roller or shaft 44 having a very small diameter. Thus, as can be seen in FIG. 2 the front edge of the chain mat continuous conveyor 46 is located very close to the leading edge 36 of gathering head 32. In the design of the front conveyor 46 of the dozer type prior art machine, it is considered essential to have a very flexible mat belt or conveyor which can make the 180° turn around on the small shaft 44. Thus, the prior art stressed the importance of very flexible chain mats or even belt conveyors to accomplish the small diameter 180° turnaround. Located adjacent the rear drive sprocket 50 of chain mat 48, and oriented end to end, according to this prior art machine, is a second continuous conveying system 52 using flight bars 53 to convey the mined material. This second or rear continuous conveying system 52 includes a front pivot or sprocket 54 and a rear pivot or sprocket 56. As is shown, both the front and rear pivot sprockets 54 and 56 of the rear flight bar conveyor 52 are of a large diameter compared to the front roller or turnaround shaft 44 of the front conveyor 46. The front pivot sprocket 54 of the rear conveying system 52 and the rear pivot sprocket 50 of the front chain mat conveyor 46 are both driven by two gear box 58 which in turn are driven by two large hydraulic drive motors 60 (only one motor and gear box shown). Because of the excessive tension that must be applied to the chain mat front conveyor 46, and because of the additional gearing required to drive two conveyors, drive motor 60 must have a substantial work capacity. It is also of interest to note that chain mat conveyor 46 has little or no pertruding structure suitable for providing rearward motion to the lumps of mined material. Thus, since the material collects at the front edge of the front conveying system, and is continually buffeted by newly mined material and the auger cutting head itself, it is desirable that the material be quickly moved away from the front of the gathering head to avoid further break up of lumps of the mined material. However, because of the lack of structure to provide rearward motion, the chain mat conveyor 46 is rather ineffective in that it simply continuously tumbles the coal or mined material as the chain mat moves underneath rather than moving the mined material rearward. Therefore, with a chain mat conveyor, the mined material tends to be further broken down into smaller lumps and even pulverized as it stays close to the cutting auger head. In addition, because of the necessary transfer of mined material from the front chain mat conveyor 46 to the flight bar rear conveyor 52 which are located end to end in the prior art machine as shown in the drawing of FIG. 2, it is not unusual for a large accumulation of coal or mined material to developed at the dead spot or juncture 62 as shown. Thus, since the front chain mat conveyor cannot move the mined material rearwardly as fast as a flight bar conveyor 46 it will be appreciated that significantly larger accumulation of coal will occur on the chain mat conveyor 48 than on the flight bar conveyor 52. Thus, as is shown in the drawing of FIG. 2 the mined material is not evenly distributed along the two part conveyor of the prior art machine. It should also be noted that although the gathering head can pivot at pivot point 35, it will be appreciated that pivoting of the gathering head is essentially limited such that the front chain mat conveyor 46 provides either a horizontal or upward conveying path as indicated by arrow 64.

Figure 3:
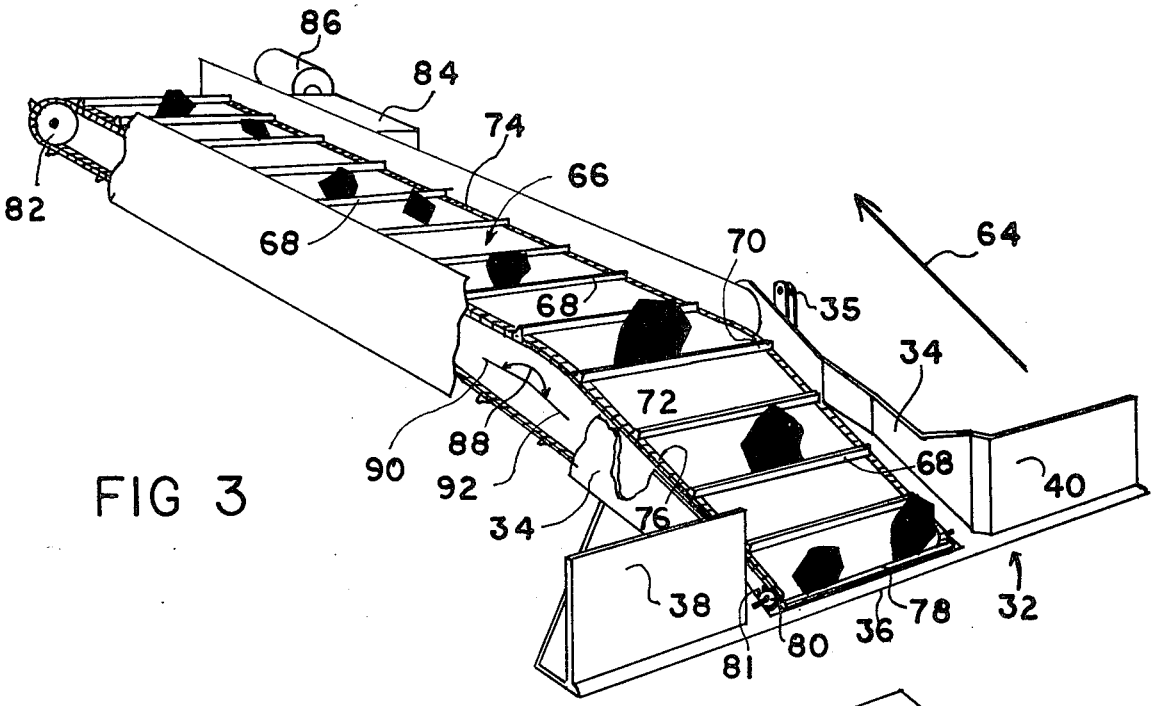
FIG. 3 is a top perspective view of the single continuous conveying system of the present invention illustrating the even distribution of the large lumps of coal along the conveying system.

Referring now to FIG. 3, there is shown the conveying system of the present invention. According to the conveying system of this invention, it can be seen that there is a single continuous conveyor 66 comprised of flight bars 68 attached at both ends 70 and 72 to two endless drive chains 74 and 76. The single continuous conveyor has a front or leading edge 78 which is located as close to the leading edge of gathering head 32 as possible. The close leading edge 78 is achieved by the use of a very small diameter or pitch turnaround shaft 80. It will be appreciated, of course, that the smaller the diameter of turnaround shaft 80, the closer leading edge 78 can be positioned to leading edge 36 of gathering head structure 32. The diameter of turnaround shaft 80 will typically be substantially the same as a link in the drive chains. It could of course, be larger, but then could not be positioned as close to leading edge 36. Turnaround shaft 80 may also include teeth 81 which mesh with drive chains 74 and 76 to prevent said driven chains from drifting along said shaft. The flight bar conveyor further has a large diameter drive sprocket 82 located at a rearmost position of conveyor 66 which is also at a rearmost position on mining machine 10. The rear drive sprocket 82 may include suitable gearing 84 and a drive motor 86, or preferably may be direct drive from motor 86 without gearing. However, it will be appreciated by those skilled in the art that unlike the chain mat continuous conveyor used in the prior art a flight bar continuous conveying system does not require the excessive tension required to keep a chain mat conveyor properly meshed with its drive sprocket. Thus, it has been found that the driving motor 86 of the single continuous conveyor 66 of this invention requires a motor 86 having a work capacity substantially only about one half that of the prior art chain mat conveyor. In addition, since there is only one conveyor, the drive motor may be located at the rear sprocket rather than at some midpoint of the machine. This allows the use of a single hydraulic motor rather than the two large hydraulic motors used in the prior art machine. Furthermore, unlike the teaching of the prior art conveyor which emphasized the need of a front portion chain mat conveyor to be able to make a small diameter turnaround, it has been found that a flight bar conveyor can indeed make the narrow diameter turnaround at the front of the gathering head. Consequently, according to this invention, since the pertruding structure of the flight bar system provides significantly more rearward motion to material, it will be appreciated that the material is quickly moved away from the front of the auger head thereby preventing continuous breakdown of the lumps and pulverization of the mined material. In addition, since there is no juncture between a front and a rear conveyor there is no accumulation of mined material at an intermediate point. Thus, as is shown in FIG. 3, large lumps of the mined material are evenly distributed along the conveyor of this invention.

It should be noted that even with the single continuous flight bar conveyor of this invention the gathering head 32 may still include a pivot point 35. The flight bar conveyor of this invention will operate just as effectively across a pivot point so long as the angle 88 between the two planes 90 and 92 is obtuse. Since as was discussed above with respect to the prior art machine such pivoting is general limited such that only obtuse angles result no reduced performance is experienced by the conveyor of this invention.

Figure 4:
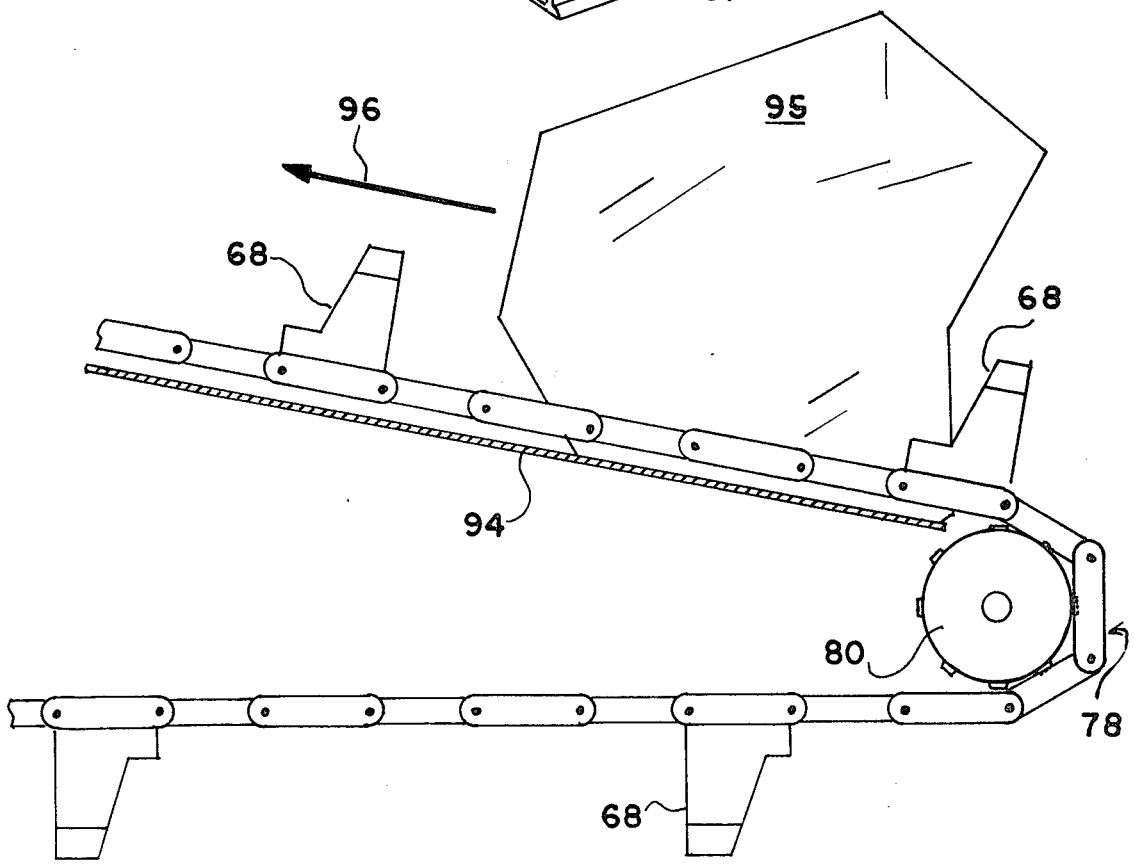
FIG. 4 is a side view of the front most portion of the conveying system of the present invention showing the small 180° turnaround, and the projections of the flight bars which contact the coal for providing rearward motion.

FIG. 4 is a more detailed side view of the conveyor of the present invention at the front end of the gathering head. As is clearly shown in the detailed view of FIG. 4, each of the flight bars 68 include a significant pertrusion above the base surface or deck 94 which extends the full length of the conveyor such that a lump of mined material or coal 95 caught between two flight bars has imparted to it significant rearward motion by such pertrusion as is indicated by arrow 96. Furthermore, as is clearly shown the flight bars according to this invention can and do make a very small diameter 180° turn around at small diameter shaft 80 such that the front edge 78 of the conveyor may be as close to the face of the mine as the leading edge 36 or the vertical panels 38 and 40.

It will also be appreciated, of course, that since the conveyor of this invention is for use with a "dozer type" gathering system, as is shown in FIG. 1, the helical cutter or auger 20 typical includes two portions having opposite scrolls such that during the cutting operation the scrolls tend to move the mined material from the outside edges to the center of the machine. The material is then, of course, picked up by the conveyor of this invention and transported to the rear of the machine.

Therefore, while there has been described what is at the present considered to be the preferred embodiment of this invention, it will be obvious to those skilled in the art that various changes and modifications may be made therein without departing from the invention as except as set forth in the following claims, and the invention is therefore, intended to cover all such changes and modifications as are in the true spirit and scope of the invention.

What is claimed is:

1. A single continuous conveyor for use with a continuous narrow seam mining machine having a dozer type gathering head, a rotating helical or auger mining head and for conveying materials from the front of said mining machine to the rear comprising:

driving means;

a pair of drive sprockets mounted at the rearward portion of said mining machine, said drive sprockets being driven by said driving means;

two continuous parallel drive chains, each of said drive chains extending from a small diameter turn around shaft at the front of the mining machine to and around said drive sprockets at the rear of the mining machine thereby forming a top portion and a bottom portion of each of said chains, said drive chains being driven by said drive sprockets such that said top portion moves in a rearward direction and said bottom portion moves in a forward direction;

a front small diameter turn around shaft, said turn around shaft having a diameter substantially equal to the length of a link of said drive chain and being located at the front most portion of said dozer gathering head and in close proximity to said rotating auger;

a multiplicity of flight bars, each of said multiplicity extending between and attached at its two ends to said two parallel drive chains; and a base surface extending the full length of said mining machine and location below said top portion of said parallel drive chains and said attached flight bars thereby forming said single continuous conveyor for transporting mined material dislodged from the face of a mine, said continuous conveyor including a pivot for allowing operation in two planes and having an obtuse angle therebetween such that a first portion of said continuous conveyor transports mined material upward and rearward from the foremost portion of the mining machine to the second portion of said continuous conveyor which extends substantially horizontal and rearward from said first portion for further transporting said material maintained to the rearmost portion of said mining machine.

2. A dozer type gathering head mining machine comprising:

a drive frame including continuous drive treads for providing motion to said drive frame;

power means attached to said drive frame, for providing driving power to said drive treads;

a mining head pivotally attached to said drive frame, said mining head including an auger cutting member positioned for rotation at the forward end of the mining head and transverse to the direction of movement of the frame and substantially parallel to the mine floor, a backup panel mounted on said mining head and to the rear of said auger cutter to provide a surface against which said auger cutters may move mined material;

a dozer gathering head which is proximate said mining head and including vertical blades which slide or telescope against said backup panels and a small diameter turn about shaft at the front of said gathering head; and a continuous conveyor comprising driving means, a pair of drive sprockets mounted at the rearward portion of said mining machine, said drive sprockets being driven by said driving means, two continuous parallel drive chains, each of said drive chains extending from and around said narrow diameter turn around shaft to and around said drive sprockets thereby forming a top and bottom portion of each of said drive chains, said turnaround shaft having a diameter selected the length of a link of said drive chains, said drive chains being driven such that said top portion moves in a rearward direction and said bottom portion moves in a forward direction, a base surface extending the full length of said conveyor and between said drive chains, a multiplicity of flight bars, each of said multiplicity extending and attached at each end between said two parallel drive chains, and a base surface extending the full length of said mining machine and located below said top portion of said parallel drive chains and said attached flight bars thereby forming said single continuous conveyor for transporting mined material dislodged from the face of a mine, said continuous conveyor including a pivot for allowing operation in two planes and having an obtuse angle therebetween such that a first portion of said continuous conveyor transports mined material upward and rearward from the foremost portion of the mining machine to the second portion of said conveyor which extends substantially horizontal and rearward from said first portion for further transporting said mined material to the rearmost portion of said mining machine.

3. The continuous conveyor of claim 1 or 2 wherein said drive means is located at the rearward portion of said mining machine and adjacent said drive sprocket.

4. The continuous conveyor of claim 1 or 2 wherein said drive means is a hydraulic motor located at the rearward portion of said mining machine and adjacent drive sprocket.

5. The continuous conveyor of claim 1 or 2 wherein said turnaround shaft includes teeth to prevent said drive chains from drifting along said shaft.

* * * * *